US008496410B2

(12) United States Patent
Winter, V et al.

(10) Patent No.: US 8,496,410 B2
(45) Date of Patent: Jul. 30, 2013

(54) METHOD AND APPARATUS FOR PENETRATING PARTICULATE SUBSTRATES

(75) Inventors: Amos Greene Winter, V, Cambridge, MA (US); Anette E. Hosoi, Cambridge, MA (US); Alexander Henry Slocum, Bow, NH (US)

(73) Assignee: Massachusetts Institute of Technology, Cambridge, MA (US)

( * ) Notice: Subject to any disclaimer, the term of this patent is extended or adjusted under 35 U.S.C. 154(b) by 630 days.

(21) Appl. No.: 12/455,392

(22) Filed: Jun. 1, 2009

(65) Prior Publication Data

US 2010/0300752 A1 Dec. 2, 2010

(51) Int. Cl.
*B63B 21/26* (2006.01)
*E21B 4/06* (2006.01)

(52) U.S. Cl.
USPC ..... 405/226; 175/285; 114/295

(58) Field of Classification Search
USPC ..... 405/224, 224.1, 226, 228; 114/294–296; 175/19, 263, 273, 285
See application file for complete search history.

(56) References Cited

U.S. PATENT DOCUMENTS

| | | | | | |
|---|---|---|---|---|---|
| 274,740 | A | * | 3/1883 | Douglass | 175/267 |
| 844,294 | A | | 2/1907 | Winslow | |
| 3,012,644 | A | * | 12/1961 | Bush | 52/162 |
| 3,603,412 | A | * | 9/1971 | Kammerer et al. | 175/260 |
| 3,636,718 | A | | 1/1972 | Keats | |
| 3,638,439 | A | | 2/1972 | Niederer | |
| 3,664,139 | A | | 5/1972 | Sexauer | |
| 3,842,608 | A | | 10/1974 | Turzillo | |
| 3,924,414 | A | | 12/1975 | Maly et al. | |
| 4,479,741 | A | | 10/1984 | Berti et al. | |
| 4,547,106 | A | * | 10/1985 | Lipsker | 405/259.3 |
| 4,640,649 | A | | 2/1987 | Nakanishi | |
| 4,693,328 | A | * | 9/1987 | Furse et al. | 175/275 |
| 4,761,096 | A | | 8/1988 | Lin | |
| 4,768,900 | A | * | 9/1988 | Burland | 405/244 |
| 4,770,256 | A | * | 9/1988 | Lipsker et al. | 175/57 |
| 4,812,079 | A | | 3/1989 | Johnson et al. | |
| 4,877,355 | A | | 10/1989 | Van Pelt | |
| 5,060,751 | A | * | 10/1991 | Kuhlman et al. | 181/102 |
| 5,271,472 | A | * | 12/1993 | Leturno | 175/107 |
| 6,129,487 | A | * | 10/2000 | Bermingham et al. | 405/228 |
| 6,764,251 | B1 | * | 7/2004 | Schnur | 405/224 |
| 6,796,380 | B2 | * | 9/2004 | Xu | 166/381 |
| 6,895,884 | B1 | * | 5/2005 | Velazquez | 114/295 |
| 6,910,831 | B2 | * | 6/2005 | Raines | 405/224.1 |
| 7,004,684 | B2 | * | 2/2006 | Fox | 405/237 |
| 7,179,145 | B2 | * | 2/2007 | Driscoll et al. | 441/7 |
| 7,350,596 | B1 | * | 4/2008 | Attaya | 175/57 |
| 8,110,967 | B2 | * | 2/2012 | Ting et al. | 310/371 |
| 2008/0273928 | A1 | | 11/2008 | Wolynski et al. | |

* cited by examiner

*Primary Examiner* — Tara M. Pinnock
(74) *Attorney, Agent, or Firm* — Hamilton, Brook, Smith & Reynolds, P.C.

(57) ABSTRACT

A method or corresponding apparatus in an example embodiment of the present invention relates to penetrating a particulate substrate using a compact, low-energy, reversible, and dynamic device for burrowing through particulate substrates. In one preferred embodiment, the apparatus includes at least one vessel and a displacement module coupled with the vessel. The actuation of the displacement module fluidizes the particulate substrate proximate to the vessel and thereby reduces resistance of the particulate substrate to movement of the vessel and causes further penetration of the apparatus through the particulate substrate. The example embodiment utilizes volume contraction and localized fluidizing to move through substrates.

3 Claims, 8 Drawing Sheets

Energy expended to soil for different burrowing methods

Power law relationship for up/in/down/out burrowing

Power law relationship for in/out-only burrowing

Power law relationship for pushing straight down 600
602
610
625
Position C 602
610
620
Position B 610
615
Position A

METHOD AND APPARATUS FOR PENETRATING PARTICULATE SUBSTRATES

BACKGROUND

Embedding rigid objects into underwater substrates is of interest in a wide range of applications. Currently available technologies (e.g., suction caisson, concrete blocks, propellant anchor, helical anchor, drag anchor, vibratory anchor, and pile) are relatively heavy and hard to transport and/or require considerable amount of energy and power for penetration of substrate and/or extraction of the penetration device. Specifically, suction caissons require large structures of orders of tens of meters and are designed to pump water out of the vessel and needs to be extracted by pressurizing the inside cavity. Similarly, Concrete blocks rely heavily on weight for anchoring force and as such are very difficult to transport. Concrete blocks are also difficult to extract once sunken into a substrate. Propellant anchors require high levels of energy to penetrate substrates and are not easily extracted. The propellant anchors also require a secondary device for insertion. Helical anchors require a counteraction torque against substrate to insert and require a torque for extraction as well. Helical anchors also require a secondary device to set in place. Drag anchors require dragging and a secondary device (e.g., ship) to set and also require a vertical pulling force for extraction. Vibratory anchors require a vibrating mass above the substrate surface and preferably above the water surface to avoid damping. The vibratory anchor also requires a pulling force for extraction. Piles require a secondary hammer system to drive into a substrate and also large vertical forces for extraction.

Fluidizing a substrate reduces burrowing resistance and facilitates penetration of a rigid body. Most existing methods in the literature rely on pumping water into substrates in order to fluidize substrates and facilitate penetration. However, pumping water into substrates is expensive and requires significant amount of energy. Therefore, it would be desirable to fluidize substrates without insertion of water.

SUMMARY OF THE INVENTION

A method or corresponding apparatus in an example embodiment of the present invention relates to penetrating a particulate substrate with a man-made or artificial vessel. In one preferred embodiment, the apparatus includes at least one vessel and a displacement module coupled with the vessel. The actuation of the displacement module fluidizes the particulate substrate proximate to the vessel and thereby reduces resistance of the particulate substrate to movement of the vessel and causes further penetration of the apparatus through the particulate substrate. The actuation of the displacement module fluidizes the particulate substrate by drawing water in or above the particulate substrate towards the vessel.

The displacement module may fluidize the particulate substrate proximate to the vessel by contracting from a first position to a second position and expanding back to the first position. The displacement module may fluidize the particulate substrate proximate to the vessel by radial or spherical expansion and contraction of the vessel. In one embodiment, the displacement module contracts and expands between the first and the second positions at predetermined time intervals and includes a predetermined time lapse between successive expansions of the vessel.

The displacement module may actuate in a horizontal direction, a vertical direction, or combination thereof, and may include a piezoelectric actuator such that actuations of the piezoelectric actuator fluidizes the particulate substrate proximate to the vessel.

Another example embodiment of the present invention relates to a method for penetrating a particulate substrate that fluidizes the particulate substrate proximate to a lower portion of an artificial vessel and fluidizes particulate substrate proximate to a side portion of the vessel. In this embodiment, the vessel will move into space occupied by the fluidized substrate at the lower portion of displacing fluidized substrate from the lower portion to a space proximate the side portion thereby penetrating the particulate substrate.

The fluidization of the particulate substrate proximate to the lower portion of the artificial vessel may be induced prior to fluidization at the side portion of the vessel. The fluidization of the particulate substrate proximate to the lower portion of the artificial vessel may be induced simultaneously with fluidization at the side portion of the vessel.

Yet another example embodiment of the present invention relates to another method and a corresponding apparatus for penetrating a particulate substrate. In one preferred embodiment, the apparatus includes a rod and an end-effector rigidly linked to the rod. The end-effector is moveable by retraction of the rod from a first position to a second position and includes at least one arm and a displacement module at the arm that is coupled with the arm. The actuation of the displacement module fluidizes the particulate substrate proximate to the arm. Specifically, retraction of the end-effector from the first position to the second position fluidizes the particulate substrate in a path of penetration and subsequent actuation of the displacement module fluidizes the particulate substrate adjacent the path of penetration. Fluidizing the particulate substrate adjacent the path of penetration reduces the resistance of the particulate substrate to movement of the end-effector and causes penetration of the apparatus through the particulate substrate.

The end-effector may include a plurality of arms that move in relation to each other in a direction normal to the path of movement of the end-effector from the first position to the second position. The end-effector may include a wedge between the arms, whereby movement of the wedge parallel to the path of movement from the first to the second position causes movement of the arms relative to each other in a direction normal to the path of the movement of the end-effector from the first position to the second position. The wedge may be linked to the rod.

Yet another embodiment may include a second end-effector such that the end-effectors are linked by the rod, and at least one of the end-effectors causes movement of the rod to thereby cause movement of the lower of the end-effectors between the first and second positions. The first and second positions may be distinct relative distances between the end-effectors.

Still another example embodiment of the present invention relates to a method for penetrating a particulate substrate that pulls a body from a first position in a particulate substrate to a second position and thereby fluidizes a portion of the particulate substrate proximate to a lower portion of the body. In this embodiment particulate substrate is fluidized proximate to a side portion of the vessel and thereby generates a volume into which fluidized particulate can be directed. Movement of the body into the space occupied by the fluidized particulate substrate proximate to the lower portion of the body directs the fluidized particulate substrate to the side portion of the vessel, thereby penetrating the particulate substrate.

The fluidization of the particulate substrate proximate to the side of the body may be caused by mechanical action. The mechanical action may be a change in diameter of the body in a direction normal to the path of flow of penetration of the particulate substrate.

The example embodiment may push the body into the space occupied by the fluidized particulate proximate the lower portion of the body to thereby displace the fluidized particulate substrate and penetrate the particulate substrate.

The present invention has many advantages. The method and apparatus of the invention can be more efficient than other methods of penetrating particulate substrates and has many applications, such as prospecting for natural resources, environmental remediation and clean up, military applications such as landmine detection, creation of low power anchors for submerged or floating systems, reversible and dynamic anchors for applications such from underwater robot tethering and oil rig mooring, tool transport in oil wells, and design of neutralizations systems for underwater mines.

The present invention can yield a power-law relationship between digging energy and depth that approximates ideal. As such, the apparatus provides exponentially higher energy efficiency than other conventional burrowing methods and nearly depth-independent drag resistance.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

One example embodiment of the present invention relates to a low-power, lightweight device for burrowing through underwater particulate substrates. The example embodiment utilizes volume contraction and localized fluidization to efficiently move through particulate substrates. The example embodiment may be used to generate compact, lightweight, low-energy, reversible, and dynamic burrowing and anchoring systems for use in under water applications.

Figure 1:
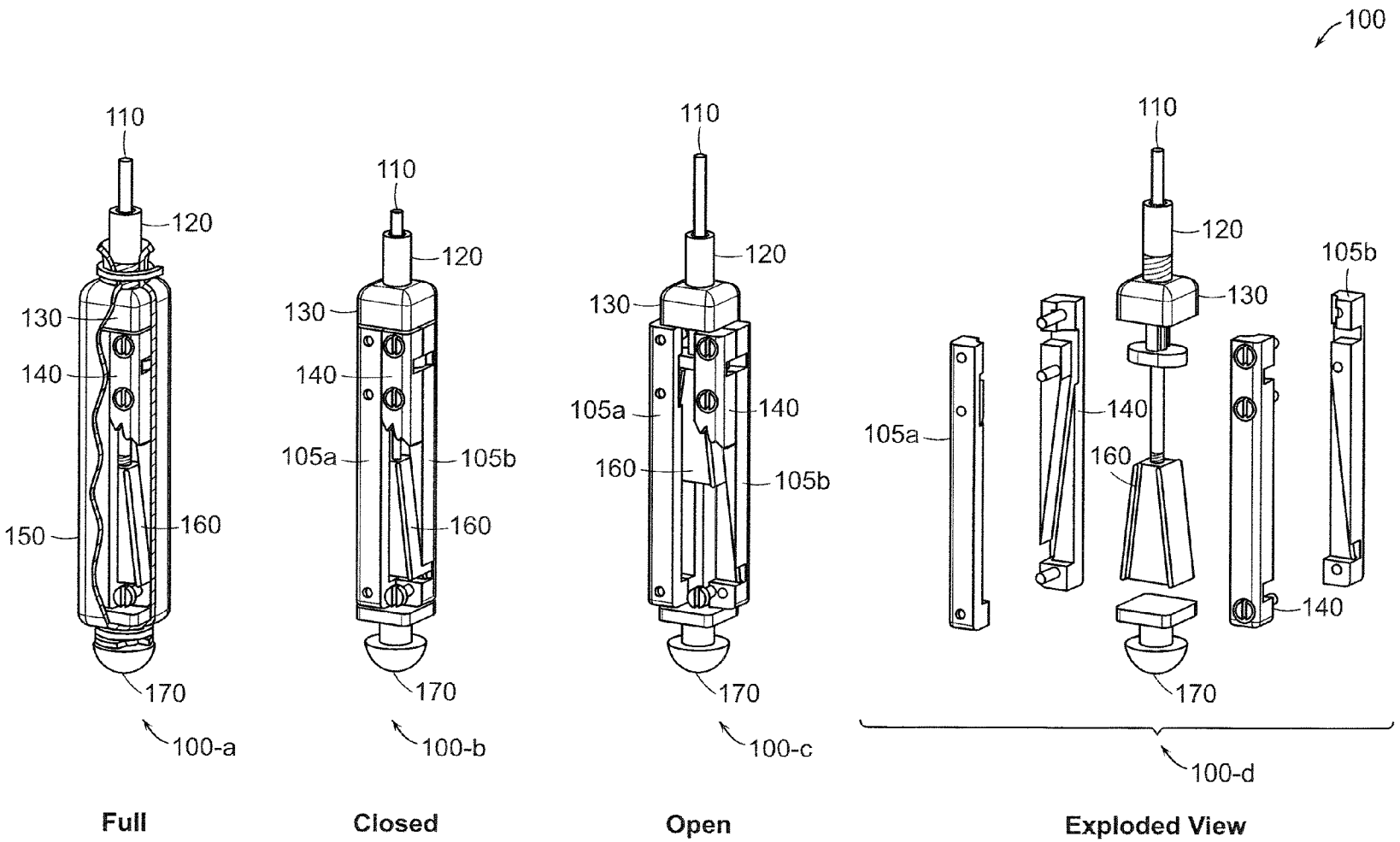
FIG. 1 illustrates an apparatus for penetrating a particulate substrate according to an example embodiment of the present invention.

FIG. 1 illustrates an apparatus 100 for penetrating a particulate substrate according to an example embodiment of the present invention. The apparatus 100 is shown in full 100-*a*, closed 100-*b*, open 100-*c*, and exploded view 100-*d* views. The apparatus 100 may be used to yield insight into the relationships between environmental and engineering parameters, such as substrate type, depth, device size, burrowing velocity, and required power.

The apparatus 100 includes a power source (not shown) compatible with marine environments and as such it avoids wall effects caused by a container and captures the peculiarities of real soil with heterogeneous composition and the presence of organic matter.

In the present example embodiment, the apparatus 100 includes an 80 cubic foot scuba tank (not shown). The scuba tank contains about one-quarter the energy of a standard 12 volt 35 Ah lead acid car battery and functions as the main power source for the apparatus.

The Apparatus 100 employs an end-effector with a leading tip 170 and at least one arm 105*a*, 105*b* to dig into soil. In some embodiments, the end-effector may include a plurality of arms that move in relation to each other in a direction normal to the path of movement of the end-effector from the first position to the second position. In the present embodiment, the end-effector includes two arms 105*a*, 105*b*. In the present embodiment, the arms 105*a*, 105*b* of end-effector are 9.97 centimeters long and 1.52 centimeters wide. The motion of the end-effector also includes two degrees of freedom, namely vertical and horizontal motions.

The horizontal motions of the end-effector, in one embodiment, occur at predetermined time intervals and for predetermined distances. In one example embodiment, the horizontal motions of the end-effector displace the arm(s) of the end-effector about 6.4 millimeters.

The horizontal motion of the arm(s) of the end-effector are accomplished using a displacement module 160. For example, in the example embodiment shown in FIG. 1, a sliding wedge 160 placed between the two arms of the end-effector serves as a displacement module 160. This mechanism is exactly constrained and has contact lengths and widths greater than two, thereby prohibiting jamming during any part of the stroke. Furthermore, the wedge 160 intersects the center of pressure on the arms 105*a*, 105*b* regardless of its position and prevents the arms 105*a*, 105*b* from exerting moments on the wedge that can increase frictional losses.

The apparatus also includes an inner rod 110 that is used to actuate horizontal movements. The inner rod 110 is housed within an outer rod 120 that is used to move the end-effector vertically, providing a compact coupling to the actuation and measurement systems of the apparatus. In some embodiments, the end-effector is surrounded by a neoprene boot 150 to prevent soil particles from entering the mechanism.

In some embodiments, the end-effector may be made from alloy 932 (SAE 660) bearing bronze and 440C stainless steel. These materials are saltwater compatible and have a low coefficient of sliding friction when lubricated. The dynamic coefficient of friction within one embodiment of the mechanism is about 0.173 with about 0.013 standard deviation under horizontal loads ranging from about 13.34 to about 83.74. Silicon oil may be used as a lubricant since it does not get absorbed by the neoprene boot.

In one embodiment, the wedge angle is about 7.13 degrees. This geometry yields a relatively high transmission ratio of about 1.55, with a maximum of about 1.83 and minimum of about 1.33 corresponding to friction measurements. The corresponding efficiency is about 39% with a minimum of about 33% and a maximum of about 46%. This level of efficiency is tolerable: packaging size, jam-free operation, and the ability to deterministically calculate lost energy outweigh the need for high efficiency. A maximum of about 60% can be achieved using a similar wedge design with the same materials and a wedge angle of about 29°.

The top nut 130 provides a connection to the outer rod 120 that moves the apparatus 100 in vertical directions. The top nut 130 also prevents the arms 105*a*, 105*b* from moving vertically relative to the top nut 130.

Figure 2B:
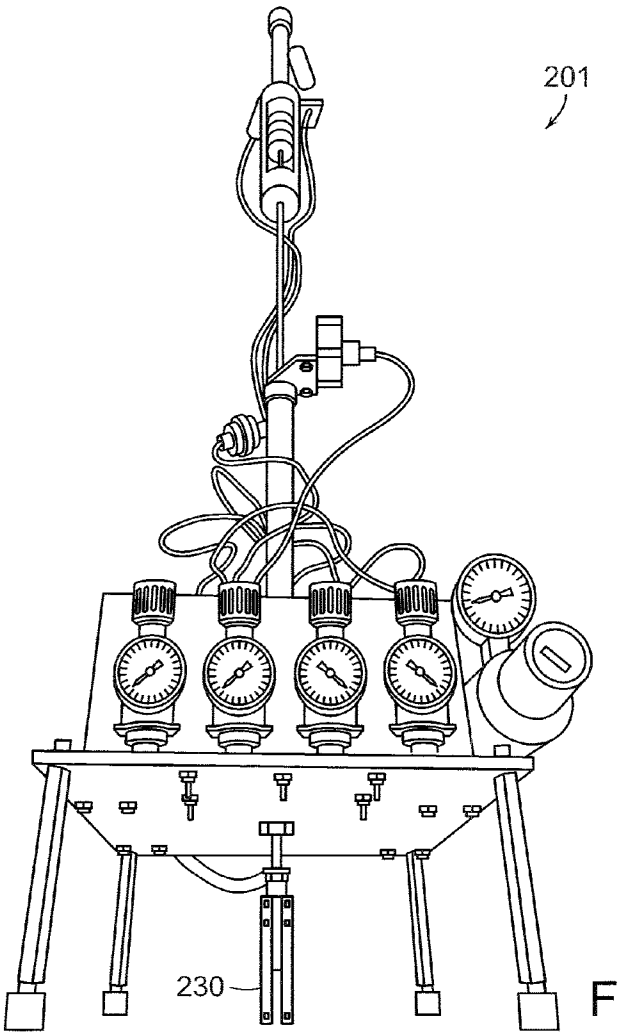
FIGS. 2A and 2B are illustration of the apparatus according to an example embodiment of the present invention.
Figure 2A:
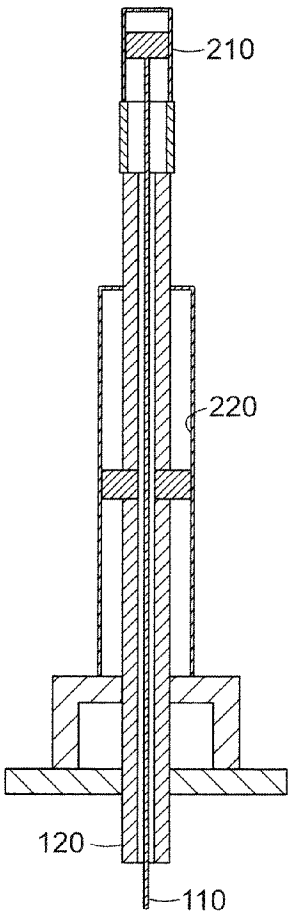

FIG. 2A is an illustration of the actuation system 200 for the apparatus according to an example embodiment of the present invention. The apparatus actuation system 200 is composed of two nested pneumatic pistons, namely an upper piston 210 and a lower piston 220. The lower piston 220 connects to the top of the end-effector and controls vertical movements of the end-effector. The upper piston 210 controls the horizontal motions of the end-effector mechanism via the in-out rod 110 that runs through the center of the lower piston 220. The nested piston configuration enables each degree of freedom to be actuated independently and provides a low-profile connection to the end-effector.

Pressure is regulated down from the scuba tank (not shown) to four independent regulators, one for each piston inlet. Air pressure delivered to the pistons 210,220 is measured by a transducer (not shown) at each input port. Displacements of the lower 220 and upper 210 pistons are measured by a string potentiometer (not shown) and an integrated linear potentiometer (not shown), respectively. Sensor excitation, data acquisition, and control of the solenoid valves that send air to the pistons are managed by a Universal Serial Bus (USB) Data Acquisition System (DAQ) device. Power to the data acquisition system is provided by the USB, and power to the solenoid valves is provided by two small onboard lead acid batteries.

The overall energy expended in soil deformation while burrowing is device-dependent and may be calculated by accounting for input energy minus all of the other losses in the system.

For the up and down motion of the apparatus, the energy lost to soil deformation during one stroke is:

$$E_{Soil}=E_{in}-E_{Friction}-E_{Potential}.$$

The energy transferred to the soil during the horizontal motions is:

$$E_{Soil}=\eta(E_{in}-E_{Friction}-E_{Potential})-E_{Boot},$$

where $\eta$ denotes the efficiency of the apparatus.

FIG. 2B illustrates the apparatus as designed and built according to an example embodiment of the present invention. In operation, the end-effector 230 is used to penetrate particulate substrates.

Experimental Results

The apparatus was tested in a substrate composed of one millimeter soda lime glass beads. Three different kinematics motions were trialed in order to form energetic comparisons between burrowing methods:

1) vertically moving the end-effector;

2) moving the end-effector horizontally and letting it fall under gravity; and 3) carrying out a combination of vertical and horizontal motions.

The minimum energy required to push straight down may be found by measuring the minimum pressure required to fully submerge the end-effector. The minimum energy required for the method involving only horizontal movements may be determined by minimizing the pressure required to open and close the end-effector at full depth. The end-effector was arranged to open and close in 6.4 millimeter strokes.

The minimum energy required to dig using the full up, in, down, and out motions may be optimized by generating a population of parameters (e.g., upward stroke time and downward stroke distance) and selecting a set of parameters that display the best minimum fitness and using the selected set of parameters to approximate the evolution of a biological system. In order to determine the best minimum fitness, a product of the energy expended per unit depth and the exponent of the energy versus depth power law relationship is employed.

Figure 3A:
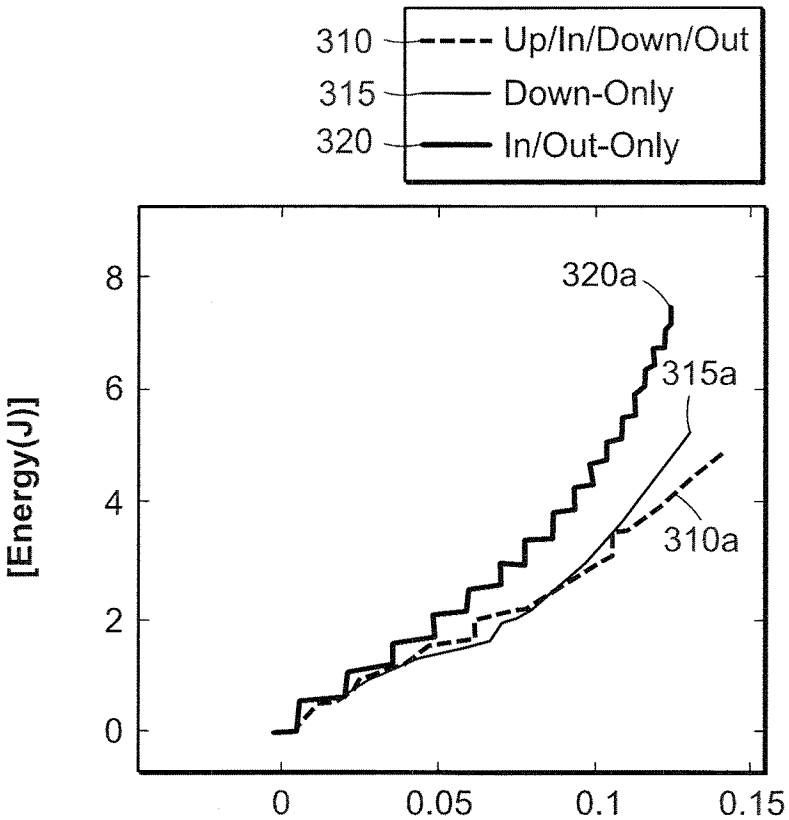
FIG. 3*a* illustrates the relationship between optimized soil deformation energy and depth for the three digging methods.

FIG. 3*a* illustrates the relationship between optimized soil deformation energy and depth for the three digging methods. As shown in FIG. 3*a*, the motion combining up, in, down, and out motions 310*a* requires the least amount of total energy over full vertical deflection of the apparatus (i.e., vertical movements 315*a* and horizontal movements 320*a*). In this example embodiment, the time intervals and displacements are as follows:

up motion: 0.032 seconds
in motion: 6.5 millimeters
down motion: 5 centimeters, and
out motion: 6.5 millimeters.

The mean coefficient of friction in the end effector mechanism was used to generate the curves shown in FIG. 3*a*.

Figure 3B:
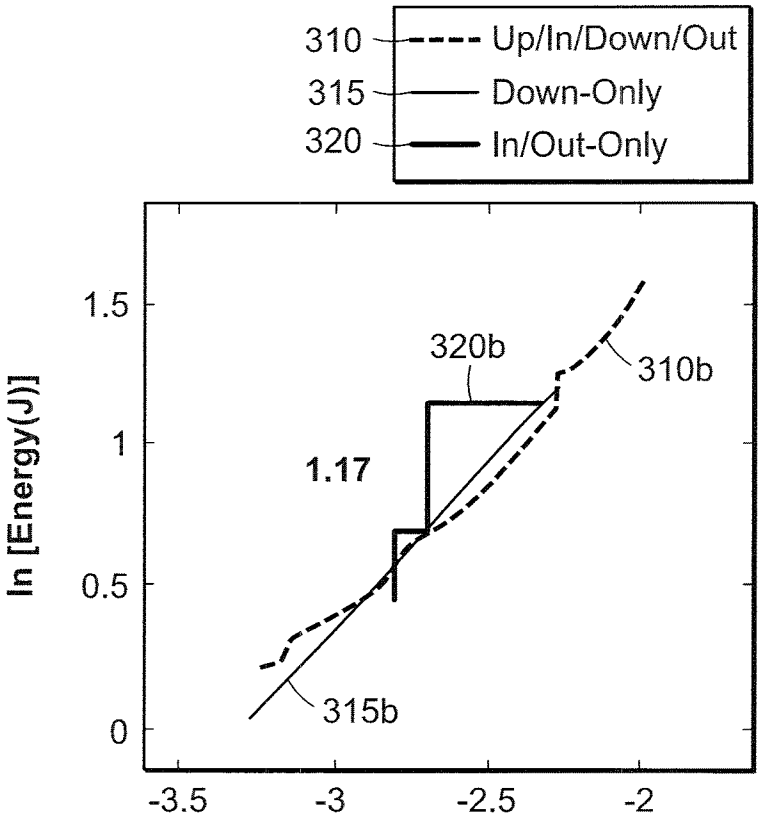
FIG. 3*b* demonstrates the power law relationship for up, in, down, and out burrowing according to an example embodiment of the present invention.
Figure 3D:
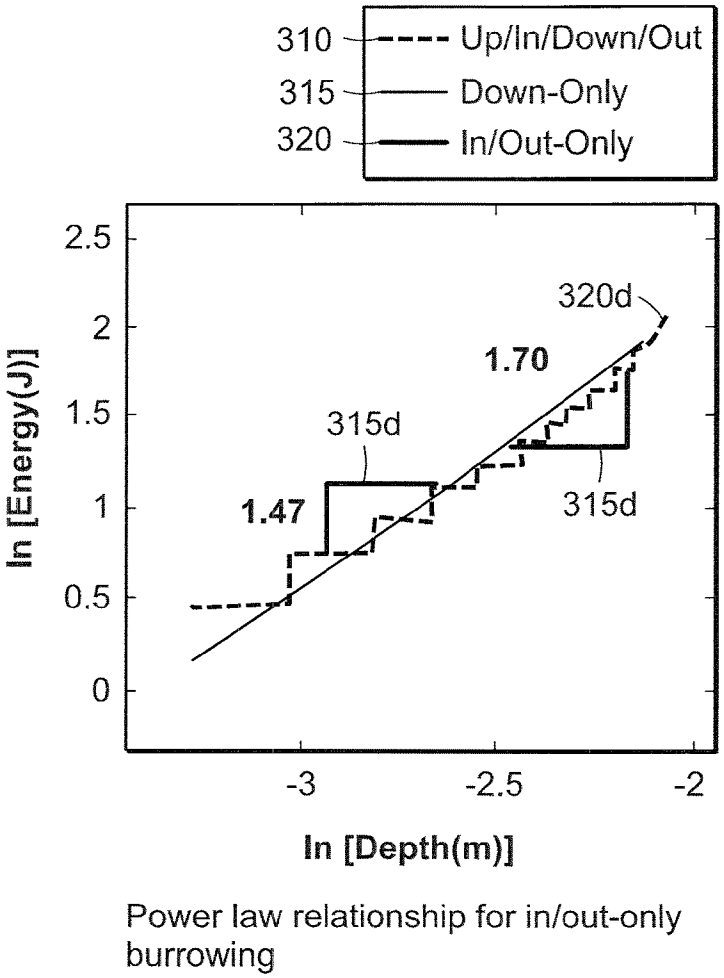
FIGS. 3*c* and 3*d* demonstrate the power law relationship for vertical and horizontal burrowing respectively.
Figure 3C:
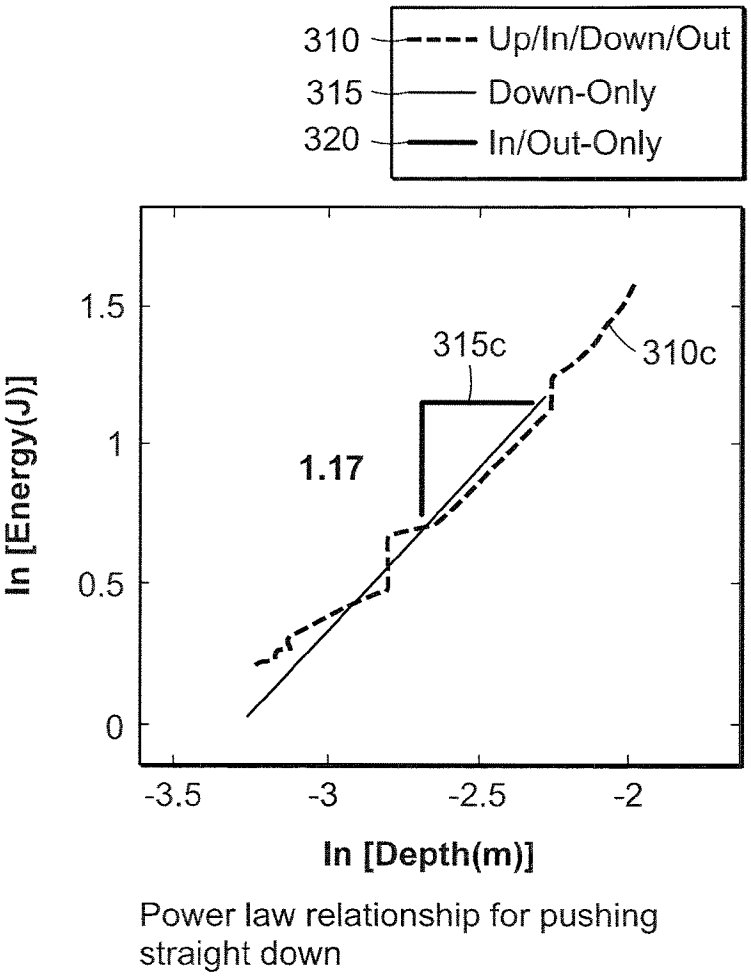
Figures 4A, 4B, 4C, 4D:
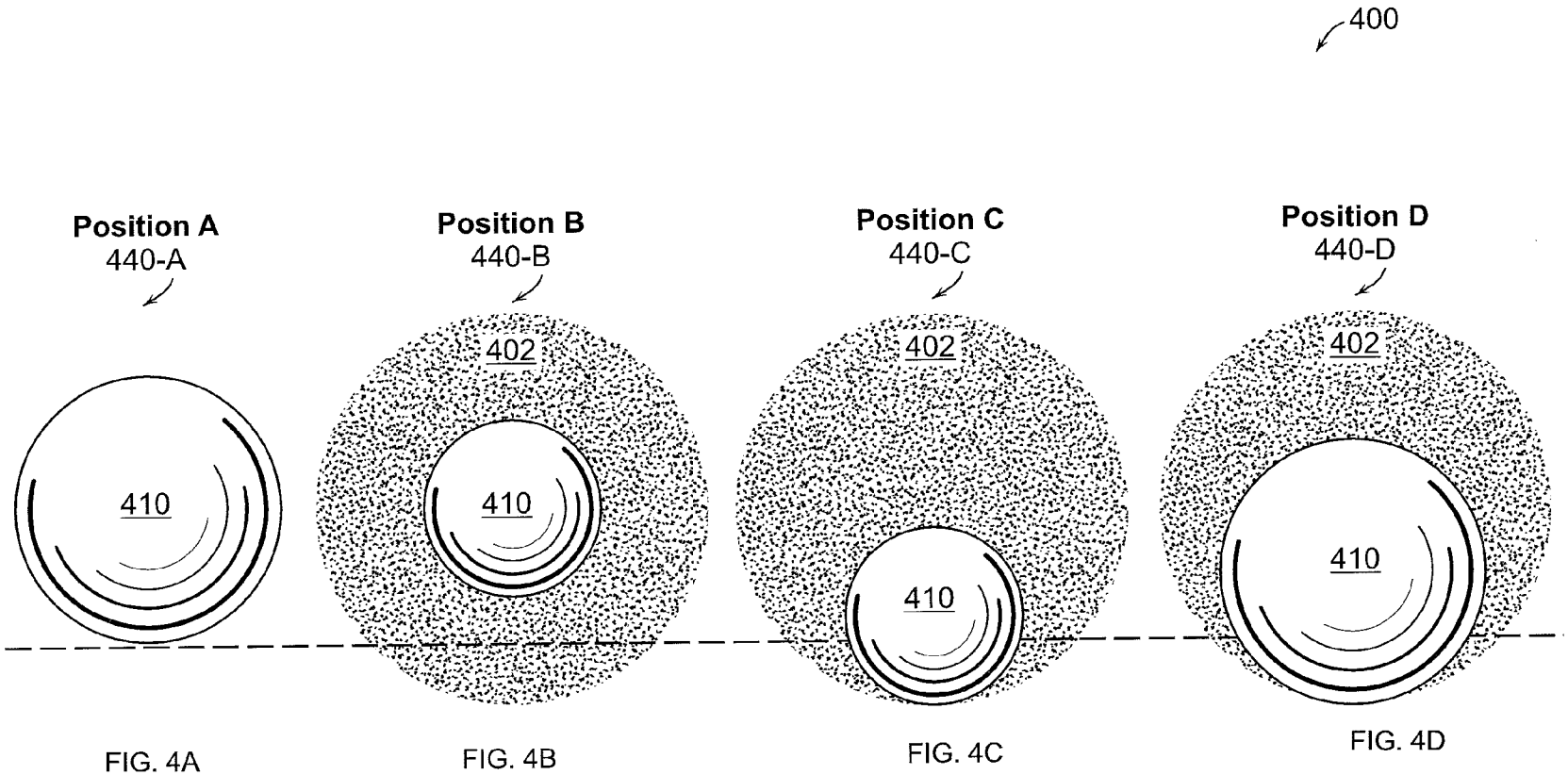
FIGS. 4A-4D illustrate views of an apparatus for penetrating a particulate substrate according to an example embodiment of the present invention.
Figures 5A, 5B, 5C, 5D, 5E:
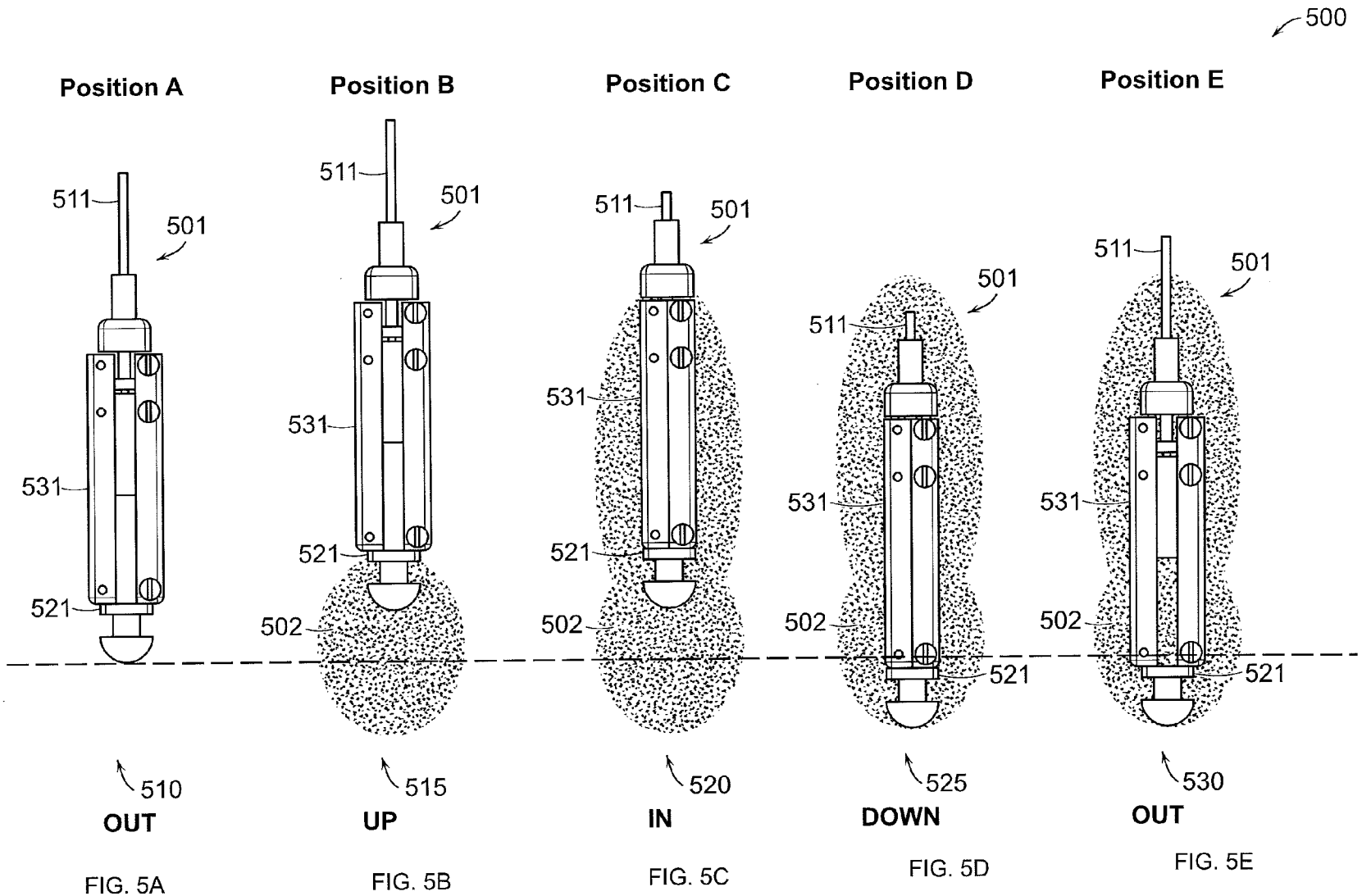
FIG. 5A-5E demonstrate an example embodiment of an apparatus for penetrating a particulate substrate.

FIG. 3*b* demonstrates the power law relationship for a non-limiting example embodiment of this embodiment of this invention that operates based on up, in, down, and out burrowing. FIGS. 3*c* and 3*d* demonstrate the law relationship for vertical and in/out only burrowing respectively.

As shown in FIG. 3*b*, the up, in, down, and out motion 310*b* yields a significantly lower slope compared to only horizontal motions 320*b* and closer to the ideal. In one embodiment the expected ideal value of n=1. Accounting for variability in friction within the effector yields a minimum slope of n=1.16 and a maximum of n=1.19.

FIG. 3*c* demonstrates the power law relationship for vertical movement 315*c* versus the horizontal and vertical motions 310*c*. The slope for vertical movements only 315*c* initially was at n=1.47 but increased to n=1.79 over the last 5 centimeters. This is very close to the expected value of n=2. The change in slope may be due to soil surface effects, as displacement of the apparatus was limited to 14 centimeters.

FIG. 3*d* illustrates that the in/out-only motion 320*d* provides no energetic benefits over straight vertical movement 315*d*, with the slope increasing to n=1.70 over the last 5 centimeters.

Thus, by employing horizontal and vertical motions the apparatus achieves considerable drag reduction.

FIGS. 4A-4D illustrate views of a vessel 410 for penetrating a particulate substrate 402 according to an example embodiment 400 of the present invention. The vessel 410 includes a vessel and a displacement module placed at the vessel (not shown).

In operation, actuation of the displacement module fluidizes the particulate substrate proximate 402 to the vessel and reduces resistance of the particulate substrate to movement of the vessel and causes further penetration of the vessel 410 through the particulate substrate 402. Specifically, while placed at a position (e.g., Position A 440A) within the particulate substrate 402, the displacement module fluidizes the particulate substrate proximate to the vessel by contracting from a first position 440-A to a second position 440-B, displacing downwards to a new position 440-C within the particulate substrate 402 (e.g., Position C 440-C), and expanding 440-D back to the first position. By repeating its expansions and contraction, the vessel 410 fluidizes the substrate 402 around itself and thereby weakens the particulate substrate 402. Once the particulate substrate 402 is weakened, the vessel is pulled down to a new position in the direction of penetration (e.g., position C 440-C and position D 440-D) under the effect of gravity. In some embodiments, the displacement module includes a piezoelectric actuator, whereby actuation of the piezoelectric actuator fluidizes the particulate substrate 402 proximate to the vessel.

FIGS. 5A-5E demonstrate an example embodiment 500 of an apparatus 501 for penetrating a particulate substrate 502. The apparatus 501 includes a rod 511 and an end-effector 521 rigidly linked to the rod 511. The end-effector 521 includes at least one arm 531 and a displacement module (not shown) at the arm 531. The horizontal movements of the arm 531 (shown as in and out movements of the arm 531 in positions C 520 and E 530 respectively) fluidize the substrate placed proximate to the arm 531. The end-effector 521 is moveable by retraction (e.g., up movement shown transferring the end-effector 521 from position A 510 to position B 520) of the rod 511 from a first position 510 to a second position 515. In this example embodiment 500, the retraction of the end-effector 521 from position A 510 to position B 520 fluidizes the particulate substrate 502 in a path of penetration and subsequent actuation of the displacement module moves the arm 531 from position B 515 to position C 520 and fluidizes the particulate substrate 502 adjacent the path of penetration. Upon fluidizing the particulate substrate 502, the resistance of the particulate substrate to movement of the end-effector is reduced (position C 520). The apparatus 501 penetrates the particulate substrate by moving down in the fluidized substrate in the direction of penetration to a third position 525 (position D).

Figures 6A, 6B, 6C:
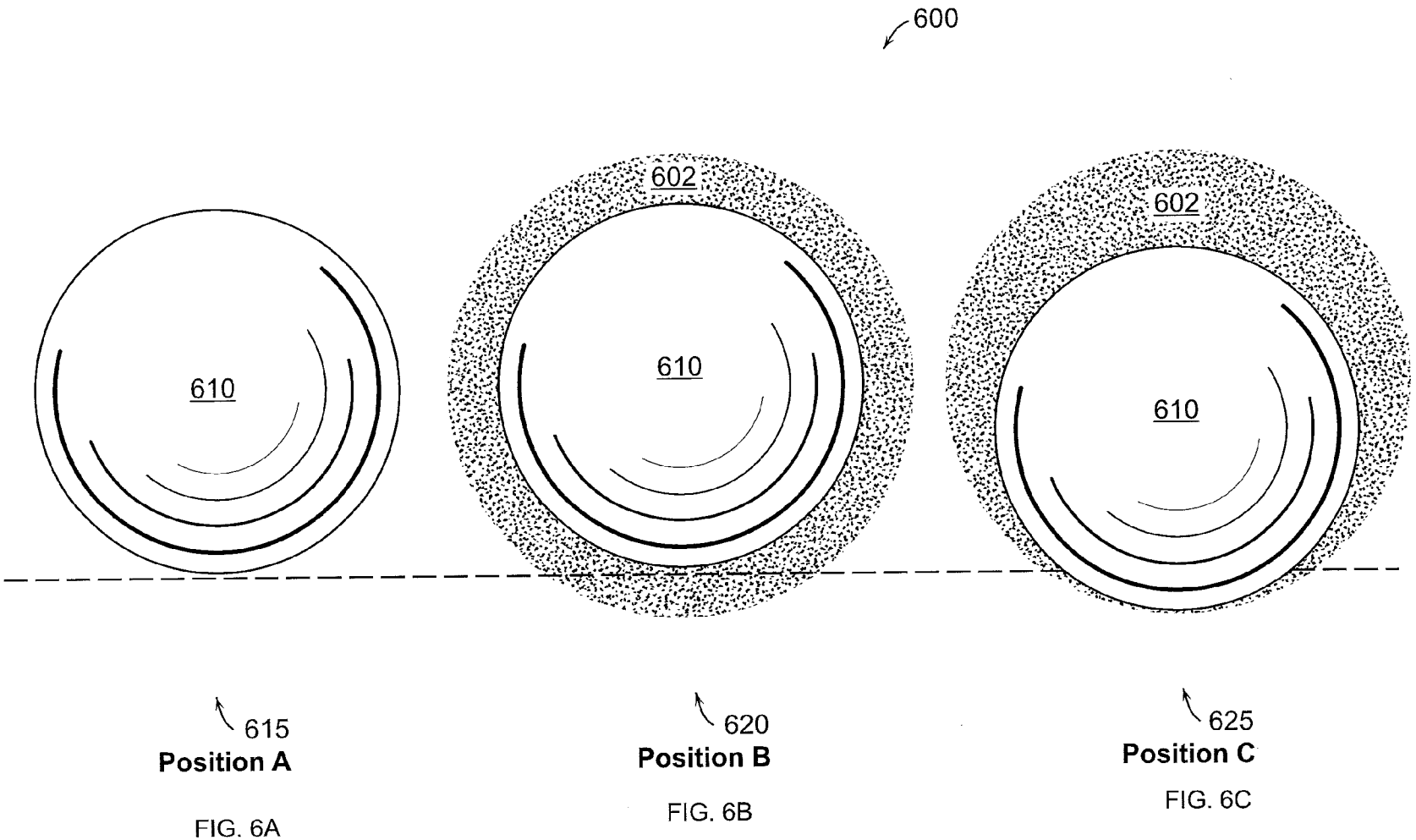
FIG. 6A-6C illustrate an example embodiment of an apparatus for penetrating a particulate substrate.
Figures 7A, 7B, 7C, 7D, 7E, 7F, 7G, 7H, 7I:
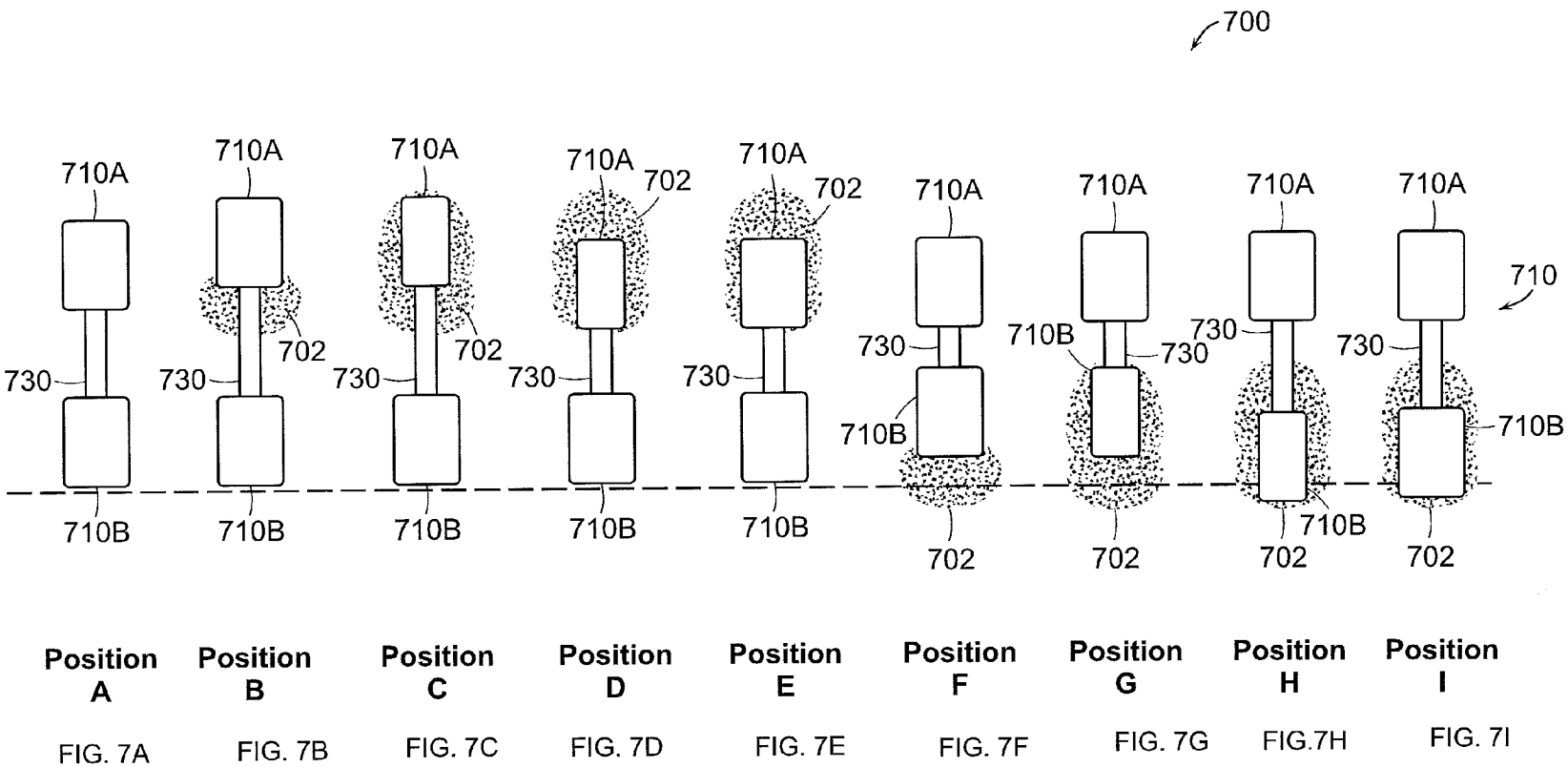
FIG. 7A-7I illustrate an example embodiment of an apparatus for penetration into a particulate substrate.

FIG. 6A-6C illustrate an example embodiment 600 of the present invention for an apparatus 610 for penetrating a particulate substrate 602. The apparatus 610 includes a vessel and a displacement module placed at the vessel (not shown). The displacement module is responsible for inducing vibrations in the vessels. The vibrations of the vessel in turn fluidize the particulate substrate 602 proximate to the vessel and reduces the resistance of the proximate substrate to the vessel. In some non-limiting embodiments the displacement module may include a piezoelectric actuator.

In the example embodiment 600 illustrated in FIG. 6, the apparatus 610 is placed at position A 615 and vibrations of the displacement module (shown in Position B 620) fluidize the particulate substrate 602 proximate to the apparatus 610. Fluidization of the particulate substrate 602 reduces the resistance of the particulate substrate 602 to the apparatus 610 and the apparatus 610 is moved down into the particulate substrate 602 under the effect of gravity.

FIG. 7A-7I illustrate an example embodiment 700 of an apparatus 710 for penetration into a particulate substrate 702. The apparatus 710 includes a rod 730 and two end-effectors, namely a top end-effector 710-A and a bottom end-effector 710-B, connected to either side of the rod 730. The apparatus is moveable by retraction of the rod 730 such that the top end-effector 710-A moves upward and away from the bottom end-effector 710-B. Each end-effector is also moveable in the horizontal direction by way of expansion and contraction. The top end-effector 710-A fluidizes the particulate substrate 702 proximate to the apparatus by a combination of horizontal and vertical movements. Specifically, the top end-effector 710-A translates vertically upward 722 (position B), contracts and translates horizontally inward 723 (position C), translates vertically and downward 724 (position D), and expands and translates outward 725 (position E). Similarly, the bottom end-effector 710-B fluidizes the particulate substrate 702 proximate to the apparatus by a combination of horizontal and vertical movements, including translating vertically upward 726 (position F), contracting and translating horizontally inward 727 (position G), translating vertically and downward 728 (position H), and expanding and translating outward 729 (position I). The combination of movements of the top and bottom end-effectors 710-A and 710-B fluidizes the particulate substrate 702 proximate to the apparatus thereby reducing resistance of the particulate substrate to movement of the apparatus 710 and causing further penetration of the apparatus 710 through the particulate substrate.

The teachings of all patents, published applications and references cited herein are incorporated by reference in their entirety.

While this invention has been particularly shown and described with references to example embodiments thereof, it will be understood by those skilled in the art that various changes in form and details may be made therein without departing from the scope of the invention encompassed by the appended claims.

What is claimed is:

1. An apparatus for penetrating a particulate substrate, the apparatus comprising:

a) a rod; and b) an end-effector rigidly linked to the rod and moveable by retraction of the rod from a first position to a second position, the end-effector including:

i) a plurality of arms that move in relation to each other in a direction normal to the path of movement of the end-effector from the first position to the second position; and ii) a displacement module that is a wedge between the arms, wherein movement of the wedge parallel to the path of movement from the first to the second position causes movement of the arms relative to each other in a direction normal to the path of the movement of the end-effector from the first position to the second position, whereby actuation of the displacement module fluidizes the particulate substrate adjacent to the path of penetration of the apparatus, and whereby retraction of the end-effector from the first position to the second position fluidizes the particulate substrate in a path of penetration and subsequent actuation of the displacement module fluidizes the particulate substrate adjacent the path of penetration, thereby reducing resistance of the particulate substrate to movement of the end-effector and causing penetration of the apparatus through the particulate substrate.

2. The apparatus of claim 1, when the rod is an outer rod that defines an annulus, and further including an inner rod within the annulus of the outer rod, wherein the wedge is linked to the inner rod.

3. The apparatus of claim 1, further including a second end-effector wherein the end-effectors are linked, and wherein movement of the lower of the end-effectors between the first and second positions causes change in the distance between the end-effectors.

* * * * *